US009595752B2

(12) United States Patent
Kaneko et al.

(10) Patent No.: US 9,595,752 B2
(45) Date of Patent: Mar. 14, 2017

(54) VEHICLE ANTENNA UNIT

(71) Applicant: HARADA INDUSTRY CO., LTD., Tokyo (JP)

(72) Inventors: Masahiro Kaneko, Tokyo (JP); Kenji Taira, Tokyo (JP); Akiyoshi Kodaka, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 37 days.

(21) Appl. No.: 14/068,592

(22) Filed: Oct. 31, 2013

(65) Prior Publication Data

US 2014/0125531 A1 May 8, 2014

(30) Foreign Application Priority Data

Nov. 2, 2012 (JP) ..... 2012-242443

(51) Int. Cl.
*H01Q 1/32* (2006.01)
*H01Q 21/28* (2006.01)
*H01Q 9/04* (2006.01)

(52) U.S. Cl.
CPC ..... *H01Q 1/3275* (2013.01); *H01Q 9/0407* (2013.01); *H01Q 21/28* (2013.01)

(58) Field of Classification Search
CPC ..... H01Q 1/3275
See application file for complete search history.

(56) References Cited

U.S. PATENT DOCUMENTS

2006/0071868 A1 4/2006 Gorai
2007/0046551 A1 3/2007 Tateno
2008/0117111 A1 5/2008 Ikeda et al.
2010/0265147 A1* 10/2010 Wakui et al. ..... 343/725
2014/0159964 A1 6/2014 Kaneko

FOREIGN PATENT DOCUMENTS

CN 1755980 A 4/2006
CN 1856902 A 11/2006
CN 101867086 A 10/2010
CN 101939876 A 1/2011
(Continued)

OTHER PUBLICATIONS

Combined Search and Examination Report issued in Application No. GB1319266.1 dated Apr. 15, 2014.
(Continued)

*Primary Examiner* — Robert Karacsony
(74) *Attorney, Agent, or Firm* — Pearne & Gordon LLP

(57) ABSTRACT

A perpendicular substrate antenna 7 is fixed vertically on an upper surface of a baseplate 3. An antenna pattern 18 is formed on the surface of the perpendicular substrate antenna 7 and a coil is 13 mounted. A plate shaped antenna 8 is attached to an upper edge of the perpendicular substrate antenna 7. The plate shaped antenna 8 includes a structure in which a pair of flat parts 81, 82 are connected via clip parts 83~86 and contact arms 93, 84, 62, 64 which contact the surface of the perpendicular substrate antenna 7 and latching arms 96, 97, 61, 62 which pass through perpendicular substrate antenna 7 and contact the opposite side surface each protrude from a lower edge of each flat part 81, 82.

7 Claims, 11 Drawing Sheets

(56) References Cited

FOREIGN PATENT DOCUMENTS

| | | | |
|---|---|---|---|
| EP | 2 690 706 | A1 | 1/2014 |
| GB | 2504030 | A | 1/2014 |
| JP | 2012-015836 | A | 1/2012 |
| JP | 2012-204996 | A | 10/2012 |
| WO | 2008/062746 | A1 | 5/2008 |
| WO | 2012/127903 | A1 | 9/2012 |
| WO | 2013/161520 | A1 | 10/2013 |
| WO | 2014/003078 | A1 | 1/2014 |

OTHER PUBLICATIONS

Office Action issued in Japanese Patent Application No. 2013-227918 dated Dec. 16, 2014.
Office Action issued in corresponding Chinese Patent Application No. 201310535160.1 dated Aug. 12, 2015.
Examination Report issued in United Kingdom Patent Application No. GB1319266.1 dated Mar. 26, 2015.
Decision for Rejection issued in Japanese Patent Application No. 2013-227918 dated Mar. 31, 2015.
Second Office Action issued in Chinese Patent Application No. 201310535160 dated Apr. 5, 2016.
Notice of Third Office Action issued in Chinese Patent Application No. 201310535160 dated Oct. 11, 2016.

* cited by examiner

VEHICLE ANTENNA UNIT

CROSS REFERENCE TO RELATED APPLICATIONS

This application is based upon and claims the benefit of priority from the prior Japanese Patent Application No. 2012-242443, filed on 2 Nov. 2012; the entire contents of which are incorporated herein by reference.

FIELD

The present invention is related to a vehicle antenna unit arranged with an antenna which receives various radio waves, and the unit is mounted and fixed on the roof of a vehicle.

BACKGROUND

Previously a receiver of radio waves such as AM/FM has been arranged on a vehicle.

Recently, forming a unit in advance by mounting an antenna as a plate shaped structure within a casing and during a manufacturing process of a vehicle fixing the vehicle antenna unit to the roof of a vehicle and connecting the antenna mounted in within the vehicle antenna unit to a receiver installed in the vehicle has become a common process based on the knowledge that it is possible to form an antenna with respect to a constant radio wave as a plate shaped structure (metal plate or a circuit board formed with an antenna pattern) as an antenna for receiving these radio waves.

However, since the distance of a non-folding antenna unit from a roof of a vehicle is regulated to approximately 7 cm, an antenna having a low height from the roof is desired as a circuit board and plate shaped antenna mounted in an antenna unit due to this regulation.

Moreover, since a vehicle roof or a base of an antenna unit in contact with the roof is a manufactured from metal in order to earth the vehicle, ineffective capacity is produced between the roof or base and the antenna which causes a drop in antenna gain. In order to avoid such as drop in gain, an antenna pattern or antenna coil on the surface of a circuit board must be arranged at a position of a height sufficiently separate from the roof. However, in an antenna unit mounted only with a circuit board, it is difficult to form an antenna pattern with a length corresponding to an AM wavelength on the circuit board. As a result, an antenna unit is proposed in which a plate shaped antenna is arranged alone or combined with a circuit board while the effective capacity of the entire antenna is maintained.

For example, in Japanese Patent Application Laid-Open Publication No. 2012-15836 (referred as "patent document 1"), an antenna unit (a roof compatible mount antenna) is disclosed including a structure in which a compound antenna formed by fixing a short axis coil element 101 to the rear side of a radio antenna (plate antenna element) 100 formed by bending a metal plate into a gable roof mold is fixed to an interior surface of a synthetic resin cover (antenna cover) 102 by double sided adhesive tape or adhesive bond as is shown in the FIG. 10 attached to the present specification.

In addition, an antenna unit including a structure in which an antenna substrate formed by mounting an antenna coil as well as forming an antenna pattern on a surface of a circuit board is fixed perpendicularly on a metal base plate (antenna base) and completely covered by a synthetic resin cover (antenna cover) is disclosed in FIG. 1 to FIG. 17 of PCT Patent Application Publication No. 2008/062746 (referred as "patent document 2"), an antenna unit (antenna device) including structure in which a gable roof plate shaped antenna (top) is fixed on an upper edge of an antenna substrate formed by mounting an antenna coil as well as forming an antenna pattern on a surface of a circuit board is disclosed in FIG. 18 of the same document, and an antenna unit (antenna device) including a structure in which an antenna comprised from a metal rod having a triangular cross-sectional shape is supported on a base plate (antenna base) and is conductive with a coil antenna is disclosed in FIG. 66 of the same document.

SUMMARY

However, in the antenna unit shown in FIG. 10 of patent document 1, although a flat plate antenna element 100 is fixed to the rear side of an upper end surface of an antenna cover 102 using an adhesive bond or double sided adhesion tape by increasing the width of the upper end surface of an antenna cover 102, sharpening the entire design image of the antenna cover 102 by narrowing the upper edge of the cover 102 is not possible according to this fixing method and therefore it is not possible to make the cover compatible with various designs. In addition, due to a decrease in adhesive strength caused by age related deterioration of the adhesive bond or double sided adhesion tape, the flat plate antenna element 100 may fall from the cover 102 or a partially peeling flat plate antenna element may become damaged due to vibrations etc. when a vehicle is in motion.

In addition, in the antenna unit described in the patent document 1, the end tip of a flat plate antenna element 100 extends obliquely in a bottom direction towards the front along the shape of the antenna cover 102 and approaches close to the roof of a vehicle. In this way, an equivalent condenser is formed between the flat plate antenna element 100 and the roof of a vehicle because the end tip of the flat plate antenna element 100 is open in the gable roof regardless of whether the end tip approaches near to the roof of a vehicle, and because ineffective capacity is produced as a result, antenna gain of the flat plate antenna element 100 drops and reception performance deteriorates.

Similarly, FIG. 11 is an antenna device described in FIG. 43 of patent document 2, because a bottom surface of an antenna 103 formed by arranging a metal rod having a triangular cross-section in a direction intersecting the plane of FIG. 11 includes a flat and wide surface area, and similarly is arranged facing near to an upper surface of a flat metal antenna base 104, an equivalent condenser is formed between the two. Consequently, ineffective capacity is increased as a result leading to a decrease in antenna gain of the antenna 103 and reception performance deteriorates.

The present invention was arrived at in view of the problems described above and aims to provide an antenna unit for a vehicle which can be fixed using a simple process without rattling and deterioration due to age while forming a plate shaped antenna into a shape which does not produce ineffective capacity between the plate shaped antenna and roof of a vehicle.

An antenna unit for a vehicle of the present invention developed in order to solve the problems described above includes a support part formed from an insulation part fixed in a perpendicular direction with respect to an upper surface of a base plate, and a main antenna part arranged with a conductive flat plate part including a surface slanting with respect to a side surface of the support part, and an arm part regulating a position of the flat plate part by contacting with the support part, a facing surface area of the main antenna part with the base plate being smaller than with the flat plate part.

The flat part in the main antenna part may be arranged only in one section of one main antenna part or a plurality of sections. In the latter case, a plurality of flat parts may be arranged in a gable roof shape. In the case where two flat parts are arranged in a gable roof shape, the two flat parts may be separated or connected by soldering for example. One plate may be curved in a gable roof shape in the case where two plate shaped parts are connected. In whichever structure, attaching a flat part to a support part may be performed at the peak section of the flat part, using an arm part or by combining both. Attachment to the peak section of the flat part may be performed by a method for inserting the peak part of the flat part into the support part for example or by a method for arranging a clamp part which clamps the upper edge vicinity of the support part between two flat parts using a structure such as a clip.

The shape of the support part may be plate shaped, frame shaped or column shaped. In the case where a plate shape is adopted, it is possible to use a circuit board as the support part. For example, it is possible to use a circuit board formed with an antenna pattern which conducts electricity to the main antenna part as the support part.

An arm is comprised from metal and may be formed by curving a part of a flat part or by adhering using solder etc to a part of the flat part and the arms may support the main antenna part by contacting (holding) the support part. That is, an arm may be formed by curving a section which protrudes from the edge of the flat part or by inserting an incision into the flat part and curving the incised portion. In addition, an arm may be formed by adhering an independent part from the flat part to the flat part using a method such as soldering, welding or riveting. An arm may pass through the support part, contact the support part or both types of arm may be combined. In the case of using an arm which passes through the support part in the case where a plurality of flat parts exists, the arm may be formed so that each flat part is separately connected to both ends of each arm. In addition, the positional relationship between a flat part and support part which is regulated by an arm may be a one way directional relationship such as an approach direction or separation direction, or a two-way direction. In the case where the positional relationship between a flat part and support part which is regulated by an arm is a one way directional relationship such as an approach direction or separation direction, it is possible to form the arm as a an elastic component. In either case, the facing area between each arm and the roof of a vehicle is required to be narrower than the facing area with respect to the flat part and the rood of the vehicle in order to reduce ineffective capacity being produced between an arm and the roof etc.

According to an antenna unit for a vehicle of the present invention having the structure described above, because a surface of a plate shaped antenna which approaches close to and is parallel with a roof of a vehicle can be reduced to a minimum, the plate shaped antenna can be fixed using a simple process without rattling and deterioration due to age regardless of the fact that ineffective capacity between the plate shaped antenna and a roof of a vehicle is not produced.

EMBODIMENTS

The embodiments of the present invention are explained below while referring the diagrams.

First Embodiment

Figure 1:
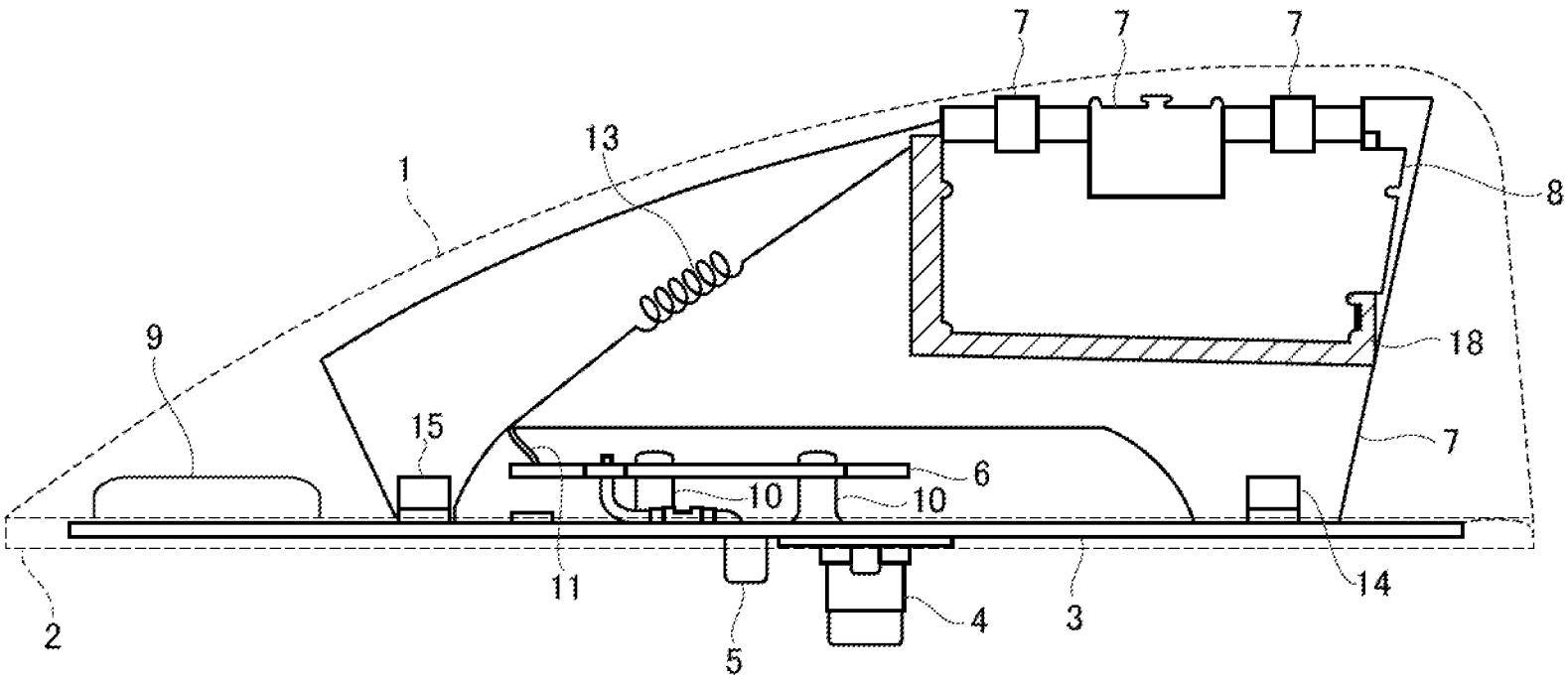
FIG. 1 is a side view diagram of an antenna unit according to one embodiment of the present invention.

FIG. 1 is a side surface perspective view of an antenna unit for a vehicle according to the present invention and shows a cover 1 and seal component 2 which form the casing of the antenna unit using a broken line. As is shown in FIG. 1, the antenna unit for a vehicle according to the present embodiment has a number of main components such as a baseplate 3 comprised form a metal plate arranged parallel to the roof (not shown in the diagram) of the vehicle, an attachment boss 4 for attaching the center of the bottom surface of the baseplate 3 to the roof, a coupler 5 attached adjacent to the attachment boss 4, a circuit board 6 fixed in a separated state via a post 10 above the baseplate 3, a perpendicular substrate antenna 7 forming a support part fixed in a perpendicular direction with respect to an upper surface of the baseplate 3, a plate shaped antenna 8 fixed near a rear end of an upper edge of the perpendicular substrate antenna 7, a patch antenna 9 fixed near a front end on the upper surface of the baseplate 3, a seal component 2 manufactured from silicon rubber which covers the circumference of the baseplate 3 from above, below and externally, and a cover 1 which covers the entire antenna unit for a vehicle. Furthermore, the baseplate 3 can also be comprised from a resin material instead of a metal plate.

The cover 1 is a roof shaped casing wherein the entire lower edge is fixed into the upper surface of the seal component 2. However, the lower edge of the cover 1 may also be fixed by welding to the baseplate 3. In addition, the entire cover 1 has shark fin shape. Furthermore, the interior surface of the cover 1 is almost the same shape as the exterior surface. Because the external appearance must be regulated so that the internally installed components of the antenna unit for a vehicle do not interfere with the interior surface of the cover 1, the shape is restricted as described below.

The baseplate 3 has a bullet shape and is slightly smaller in circumference than the cover 1. The patch antenna 9 is fixed near to the forward end of the surface of the baseplate 3.

The attachment boss 4 is inserted through a through hole in the roof of the vehicle not shown in the diagram.

A lead wire 11 is which conducts with a base end of an antenna pattern formed on the perpendicular substrate antenna 7 is connected to the circuit board 6.

The perpendicular substrate antenna 7 is mounted with a coil 13 as well as the antenna pattern formed on both surfaces (not shown in the diagram) and is connected to the plate shaped antenna 8 which forms a section of the main antenna part described below. The bottom edge of the perpendicular substrate antenna 7 is fixed to the baseplate 3 via fixing components 14, 15 on the upper surface of the baseplate 3. In addition, the upper edge of the perpendicular substrate antenna 7 is formed in a shape which runs along the ridge of the cover 1.

A wire which forms the antenna pattern 18 is cut out by etching a copper thin film the same as a wire on a usual resist substrate, and includes a shape in which each series and single wires are folded back multiple times. Furthermore, a resist for preventing oxidation is coated on the surface of the antenna pattern 18.

The coil 13 is connected between the circuit board 6 and the antenna pattern 18 in order to compensate for the fact that the entire length of a radio antenna (antenna pattern 18 and plate shaped antenna 8) can not be sufficiently secure due to the restriction of the size of the entire antenna unit.

Figure 2:
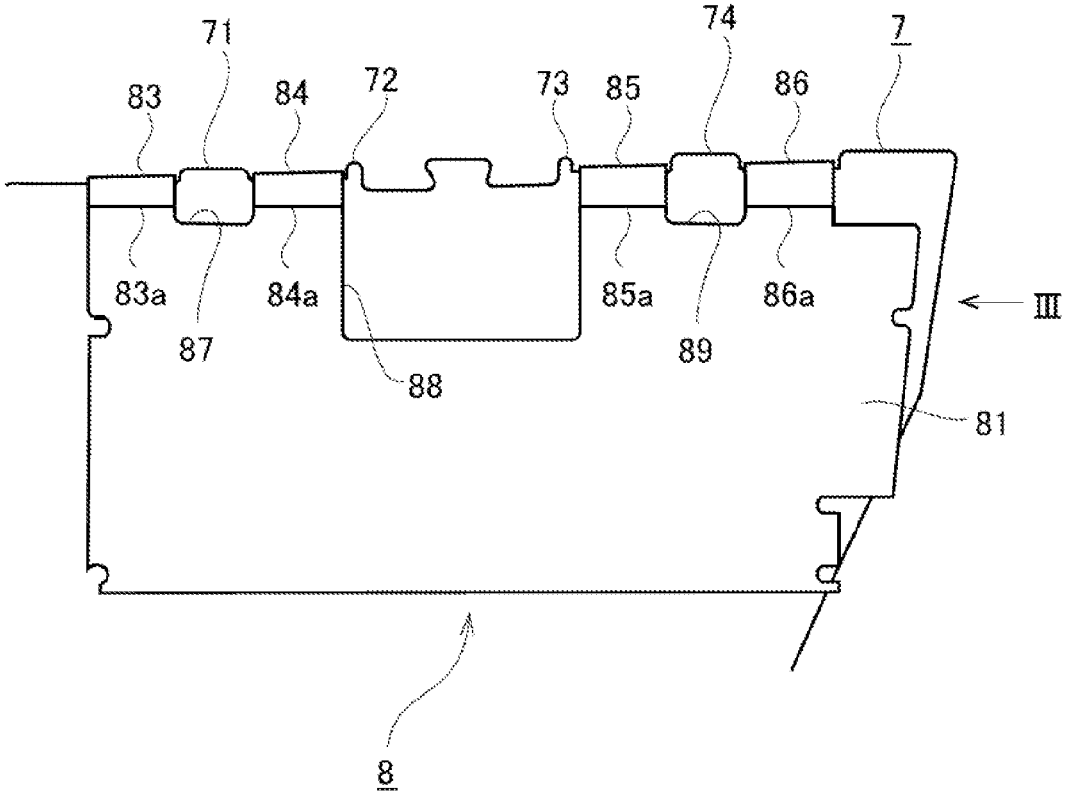
FIG. 2 is a side view diagram of a fixing structure of a plate shaped antenna to a perpendicular type substrate antenna.
Figure 3:
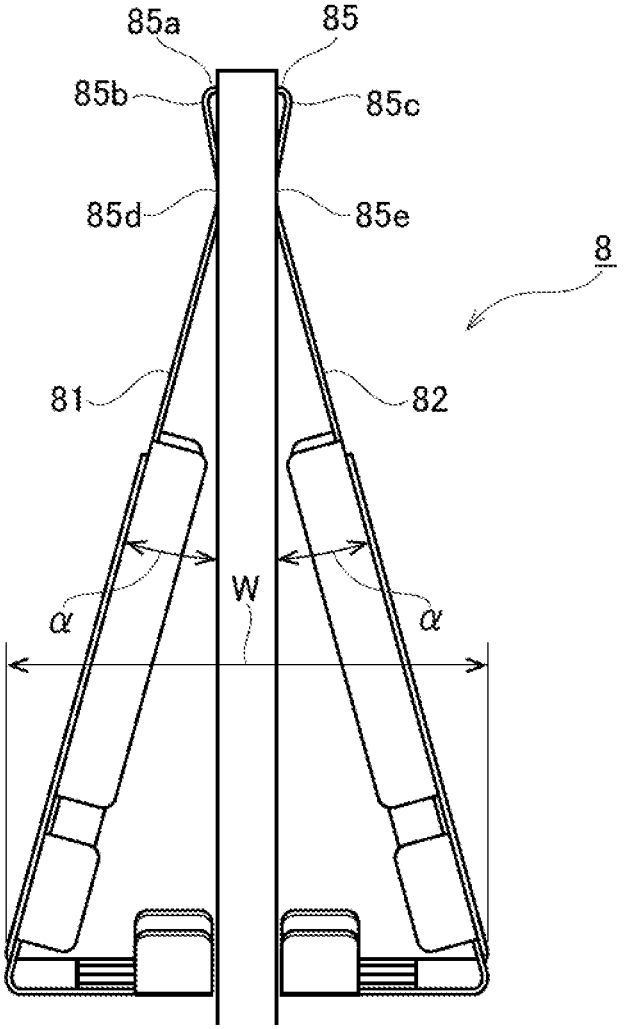
FIG. 3 is a rear view diagram of the perpendicular type substrate antenna and plate shaped antenna seen from the direction III in FIG. 2.
Figure 4:
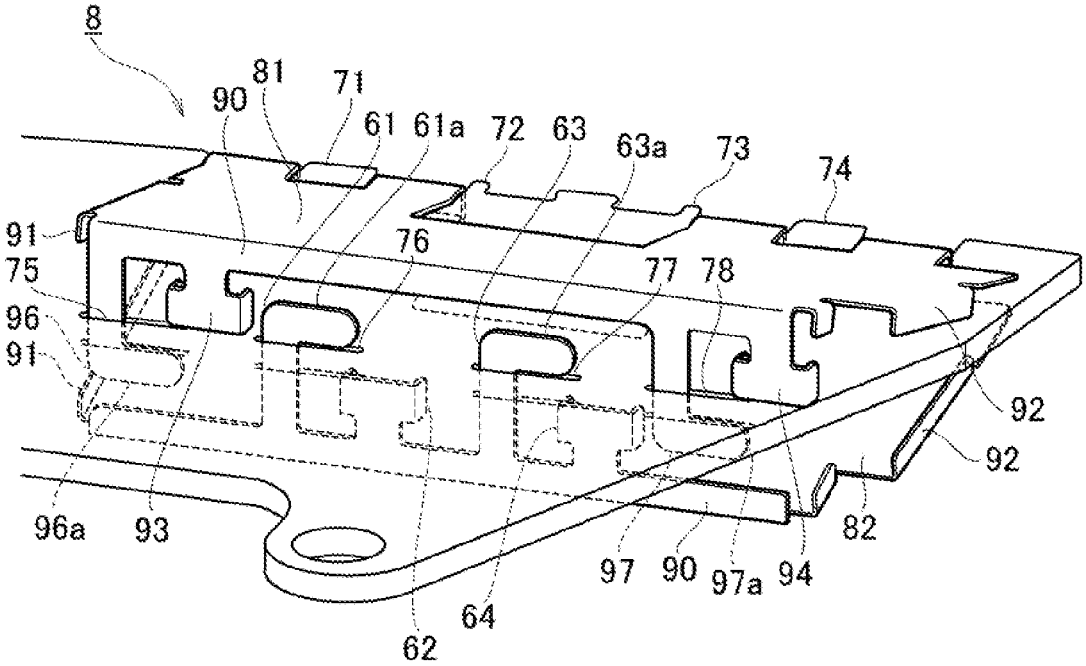
FIG. 4 is a perspective view diagram showing the state of a plate shaped antenna fixed using an arm to a perpendicular type substrate antenna with the point of sight on the lower right in FIG. 1.

The plate shape antenna 8 is punched out of a metal plate with a high conductivity and high elastic coefficient metal such as aluminum or stainless steel by a press process and is curved by plastic deformation. Specifically, as is shown in the partial expanded side surface view in FIG. 2, the rear surface view in FIG. 3 and the perspective view in FIG. 4, the plate shape antenna has a gable roof type shape. Furthermore, a pair of flat parts 81, 82 having a roughly U shape arranged on the front and rear surface of the perpendicular substrate antenna 7 respectively are connected as a single unit via clip parts 83~86 at four sections.

In addition, a plurality of protruding parts 71~74 inserted into each aperture part 87~89 at three sections formed between each pair of clip parts 83~86 on the plate shaped antenna 8 are formed on the upper edge of the perpendicular substrate antenna 7. Therefore, the plate shaped antenna 8 is positioned in a parallel direction (forward and back direction) to the perpendicular substrate antenna 7 while the plate shaped antenna 8 is fixed to the upper edge of the perpendicular substrate antenna 7. In addition, at any one of the aperture parts 87, the plate shaped antenna 8 is soldered to one end of the antenna pattern 18 above the perpendicular substrate antenna 7.

Ribs 90, 91, 92 which form a part of the main antenna part curved towards the direction of the perpendicular substrate antenna 7 are each arranged on a bottom edge and front and rear edges of each flat part 81, 82 on the plate shaped antenna 8. Furthermore, the ribs 91 and 92 formed on front and rear edges of each flat part 81, 82 are formed only in a range which does not interfere with the perpendicular substrate antenna 7 and are curved in a perpendicular direction with respect to the flat parts 81, 82.

The width W (refer to FIG. 3) of pairs of bottom edges of each flat part 81, 82 on the plate shaped antenna 8, and the angular aperture $\alpha$ (refer to FIG. 3) with respect to the perpendicular substrate antenna 7 and each flat part 81, 82 are dependent on the shape of the space within the cover 1 and are designed to be as large as possible without contacting the interior surface of the cover 1.

In order to regulate a reduction in the distance up to the angular aperture $\alpha$ with respect to the perpendicular substrate antenna 7 of the flat part 81 and the perpendicular substrate antenna 7, a first type of contact arm 93, 94 which form a part of the main antenna part each protrude from the vicinity of a rear end and front end at the rib 90 on the bottom edge of the flat part 81 and the front end contacts in a perpendicular direction to the surface of the perpendicular substrate antenna 7. Furthermore, because the front end of each contact arm 93, 94 is curved so that the edge of the front end has a clamp like shape, each contact arm 93, 94 is prevented from falling into slits 75~78 which are described below.

In addition, in order to regulate an increase in the distance up to the angular aperture $\alpha$ with respect to the perpendicular substrate antenna 7 of the flat part 81 and a reduction in the distance up to the perpendicular substrate antenna 7, second type latching arms 96, 97 which form a part of the main antenna part each protrude from the vicinity of a rear end and front end at the rib 90 on the bottom edge of the flat part 81 and the front end passes through slits 75, 78 on the perpendicular substrate antenna 7 with the long-axis direction facing horizontally and protrudes to the opposite side surface of the perpendicular substrate antenna 7. Because hook parts 96*a*, 97*a* which protrude through each slit 75, 78 only when the forward end edge of each contact arm contacts the surface of the perpendicular substrate antenna 7 are formed on the forward end of each latching arm 96, 97, the overall shape of each latching arm 96, 97 is an L shape. In addition, the hook parts 96*a*, 97*a* of each latching arm 96, 97 protrude completely through each slit 75, 78 to be plastic deformed in an upwards direction by an assembly operator with the interior side edge contacting the opposite side surface of the perpendicular substrate antenna 7.

In this way, because the interior side edge of the hook parts 96*a*, 97*a* of each latching arm 96, 97 contacts the opposite side surface of the perpendicular substrate antenna 7 at the same time as when the forward end edge of each contact arm 93, 94 contacts the surface of the perpendicular substrate antenna 7, the flat plate part 81 does not vibrate and the distance up to the angular aperture $\alpha$ with respect to the perpendicular substrate antenna 7 of the flat part 81 and the distance up to the perpendicular substrate antenna 7 is fixed.

Alternatively, latching arm 61, contact arm 62, latching arm 63 and contact arm 64 are formed in this order to protrude from the forward end side in a region equivalent to a space between the contact arm 93 and latching arm 97 of the flat part 81 on the rib 90 of the bottom edge of the flat part 82 so as not to interfere with the contact arm 93 and latching arm 97. The shape and function of the contact arms 62, 64 and latching arms 61, 63 are the same as those of the flat part 81 described above.

Therefore, because the interior side edge of the hook parts 61*a*, 63*a* of each latching arm 61, 63 contacts the surface of the perpendicular substrate antenna 7 at the same time as when the forward end edge of each contact arm 62, 64 contacts the opposite side surface of the perpendicular substrate antenna 7, the flat part 82 does not vibrate and the distance up to the angular aperture $\alpha$ with respect to the perpendicular substrate antenna 7 of the flat part 82 and the distance up to the perpendicular substrate antenna 7 is fixed.

As described above, each part is curved by press processing in advance before the plate shape antenna 8 according to the present embodiment is attached to the perpendicular substrate antenna 7. Thus, an assembly operator widens the gap between the two flat parts 81, 82 to create a gap between the forward ends of the latching arms 96, 97 and 61, 63 and presses the upper edge of the perpendicular substrate antenna 7 into the gap. In addition, when an assembly operator presses each protrusion 71~74 of the perpendicular substrate antenna 7 into the aperture parts 87~89 corresponding to the plate shape antenna 8, each latching arm 95, 96, 61, 63 is simultaneously inserted into each slit 75, 78, 76, 77. Then, each clip part 83, 84, 85, 86 clamps the vicinity of the upper edge of the perpendicular substrate antenna 7 due to elasticity as an opposite reaction to the elastic deformation of the entire plate shaped antenna 8, the forward end edge of each contact arm 93, 94, 62, 64 of the flat parts 81, 82 contacts each surface of the perpendicular substrate antenna 7 and each hook part 96*a*, 97*a*, 61*a*, 63*a* of each latching arm 96, 97, 61, 63 of each flat part 81, 82 protrude through the perpendicular substrate antenna 7. Thus, an assembly operator plastically transforms the hook parts 96*a*, 97*a*, 61*a*, 63*a* of each latching arm 96, 97, 61, 63 in an upwards direction using a jig.

In this way, assembly by an assembly operator is easy and because special components are not required for fixing the plate shaped antenna 8 to the perpendicular substrate antenna 7, assembly costs and component costs can be reduced. Moreover, because the plate shaped antenna 8 is fixed rigidly to the perpendicular substrate antenna 7 producing no vibrations, long term reliability is excellent, it is possible to set the clearance with the interior surface of the cover 1 to a minimum and therefore the level of design freedom of the cover 1 and antenna is high.

The plate shaped antenna 8 fixed to the perpendicular substrate antenna 7 as described above is soldered to the end of the antenna pattern 18 and becomes conductive. As a result, the space from the lead wire 11 to the plate shaped antenna 8 is continuously conductive, the antenna pattern 18 and plate shaped antenna 8 function as a receiver antenna of AM broadcast radio waves and at the same time, the coil 13, antenna pattern 18 and plate shaped antenna 8 function as a receiver of FM broadcast radio waves.

At this time, because the antenna pattern 18 is sufficiently separated from the base plate 3 and roof of the vehicle, it is possible to significantly reduce the generation of ineffective capacity between these parts. Similarly, the plate shaped antenna 8 is also sufficiently separated from the base plate 3 and roof of the vehicle and because the parts parallel with the base plate 3 and roof of the vehicle are limited to the rib 90 and each arm 93, 94, 96, 97, 61, 62, 63, 64 and the backs 83*a*~86*a* of each clip part 83~86, and because the hook parts 96*a*, 97*a*, 61*a*, 63*a* of each latching arm 96, 97, 61, 63 are curved in an upwards direction, it is possible to significantly reduce the generation of ineffective capacity between the base plate 3 and roof the vehicle. When the base plate is made of resin, the distance between the antenna pattern 18, plate shaped antenna 8, each arm part and each clip part and the roof of a vehicle will be separated by the thickness of the base plate. Thereby, ineffective capacity may be reduced.

In this way, according to the antenna unit of the present embodiment, because the generation of ineffective capacity is significantly reduced, it is possible to secure antenna gain and maintain a high reception performance.

Second Embodiment

Figure 5:
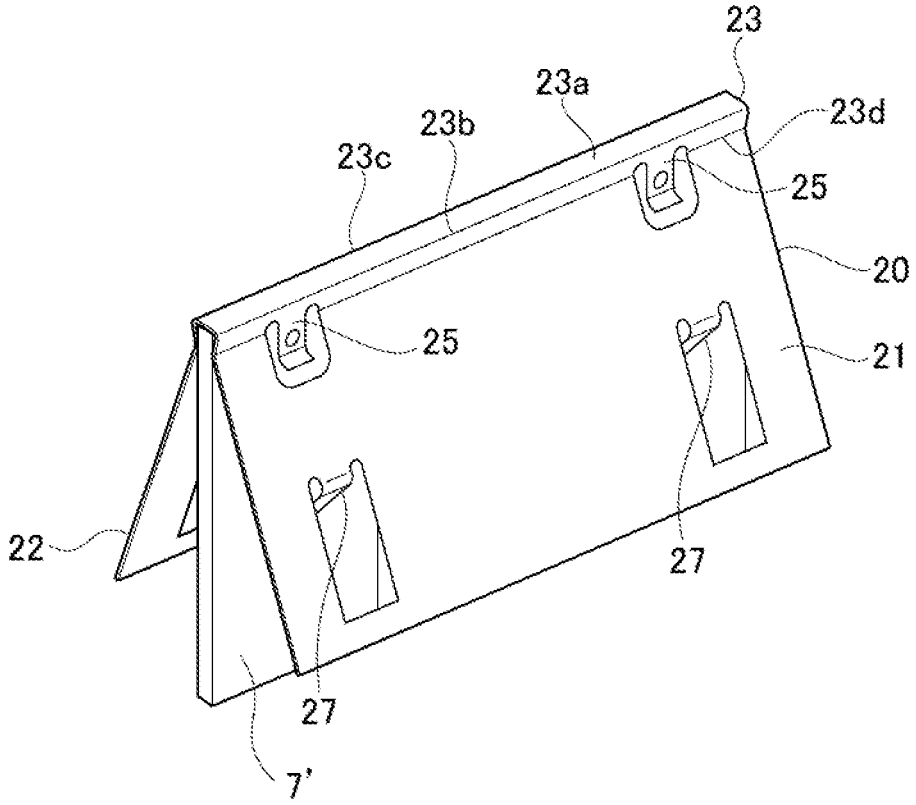
FIG. 5 is a perspective view diagram of a perpendicular type substrate antenna and flat shaped antenna mounted within an antenna unit according to the second embodiment of the present invention.

FIG. 5 is a perspective view diagram which shows only a plate shaped antenna 20 and a part of a perpendicular substrate antenna 7' (rear end vicinity part on an upper edge attached with the plate shaped antenna 20) mounted in the antenna unit according to the second embodiment of the present invention. Because the structure of other parts in the second embodiment is the same as those of the first embodiment, an explanation and illustration is omitted. In addition, apart from an upper edge of the perpendicular substrate antenna 7' being a straight line and not passing through slits 75~78, the perpendicular substrate antenna 7' is the same as the perpendicular substrate antenna 7 of the first embodiment described above and an explanation is omitted here.

The plate shaped antenna 20 shown in FIG. 5 according to the second embodiment is punched out of a metal plate with a high conductivity and high elastic coefficient metal such as aluminum or stainless steel by a press process and is curved (plastic deformed). Specifically, as is shown in the side surface view in FIG. 6, the planar view in FIG. 7, the rear surface view in FIG. 8 seen from the direction of the arrow VIII in FIG. 6 and the vertical cross-sectional view in FIG. 9 along the line IX-IX in FIG. 6, the plate shape antenna 20 has an equal gable roof type shape, a pair of flat parts 21, 22 having a rectangular exterior edge arranged on the front and rear surface of the perpendicular substrate antenna 7 respectively are connected as a single unit via a clip part 23.

Figure 8:
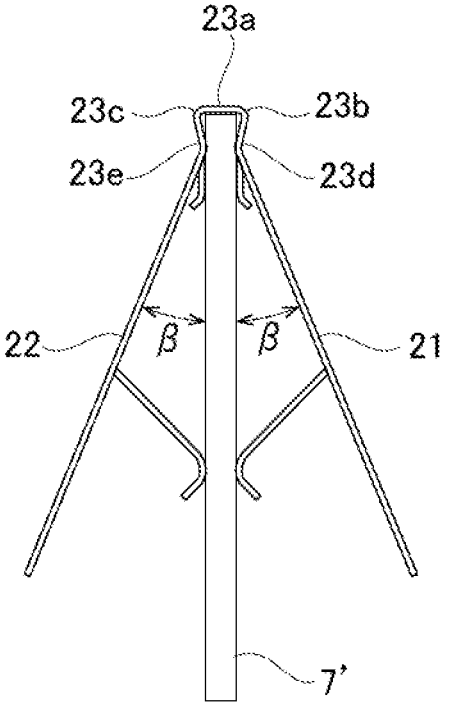
FIG. 8 is a rear surface view diagram of the perpendicular type substrate antenna and the flat shaped antenna seen from the direction VIII in FIG. 6.
Figure 9:
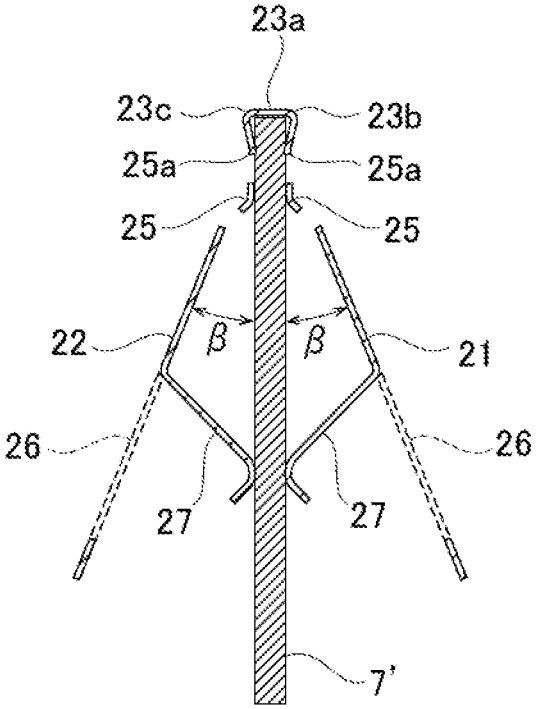
FIG. 9 is a perpendicular cross-sectional view diagram of the perpendicular type substrate antenna and the flat shaped antenna along the line IX-IX in FIG. 6.
Figure 10:
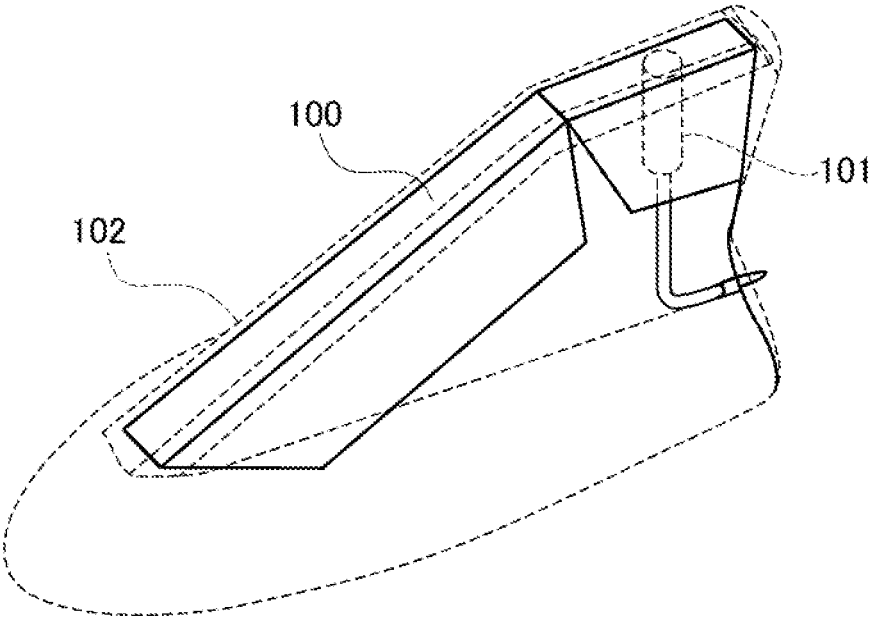
FIG. 10 PRIOR ART
FIG. 10 is a perspective view diagram showing an example of a conventional antenna unit.
Figure 11:
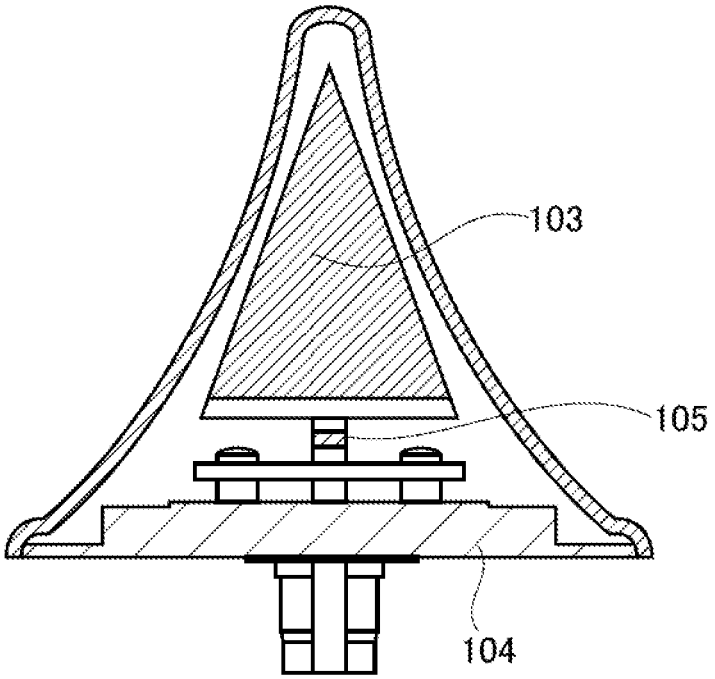
FIG. 11 PRIOR ART
FIG. 11 is a perpendicular cross-sectional view diagram showing an example of a conventional antenna unit.

A clip part 23 has equal metal plate shape of a fold back clip (double clip, binder clip) and clamps the upper edge of the perpendicular substrate antenna 7' according to the operating principle of a clip. That is, as is shown in FIG. 8 and FIG. 9, the clip part 23 has a space between a pair of curved line 23*b*, 23*c* set parallel with a slightly wider gap than the thickness of the perpendicular substrate antenna 7' forming a back 23*a* and both sides of the back 23*a* are curved (plastically deformed) to a sharp angle at each curved line 23*b*, 23*c*. Therefore, a gap between a pair of forward ends (curved parts 23*d*, 23*e* which form a boundary with each planar part 21, 22) of the clip part 23 is narrower than the thickness of the perpendicular substrate antenna 7' in a natural state removed from the perpendicular substrate antenna 7', and by elastically deforming the entire clip part 23 and widening the space between the flat parts 21, 22, it is possible to make the gap between the pair of forward ends (curved parts 23*d*, 23*e* which form a boundary with each planar part 21, 22) of the clip part 23 wider than the thickness of the perpendicular substrate antenna 7'. In addition, when the upper edge of the perpendicular substrate antenna 7' is pushed into this gap, because the pair of forward ends (curved parts 23*d*, 23*e* which form a boundary with each planar part 21, 22) of the clip part each press on the front and rear surfaces of the perpendicular substrate antenna 7' due to elasticity as an opposite reaction to the elastic deformation described above, the clip part 23 becomes fixed to the perpendicular substrate antenna 7' and therefore the entire plate shaped antenna 20 becomes fixed to the perpendicular substrate antenna 7'.

Figure 6:
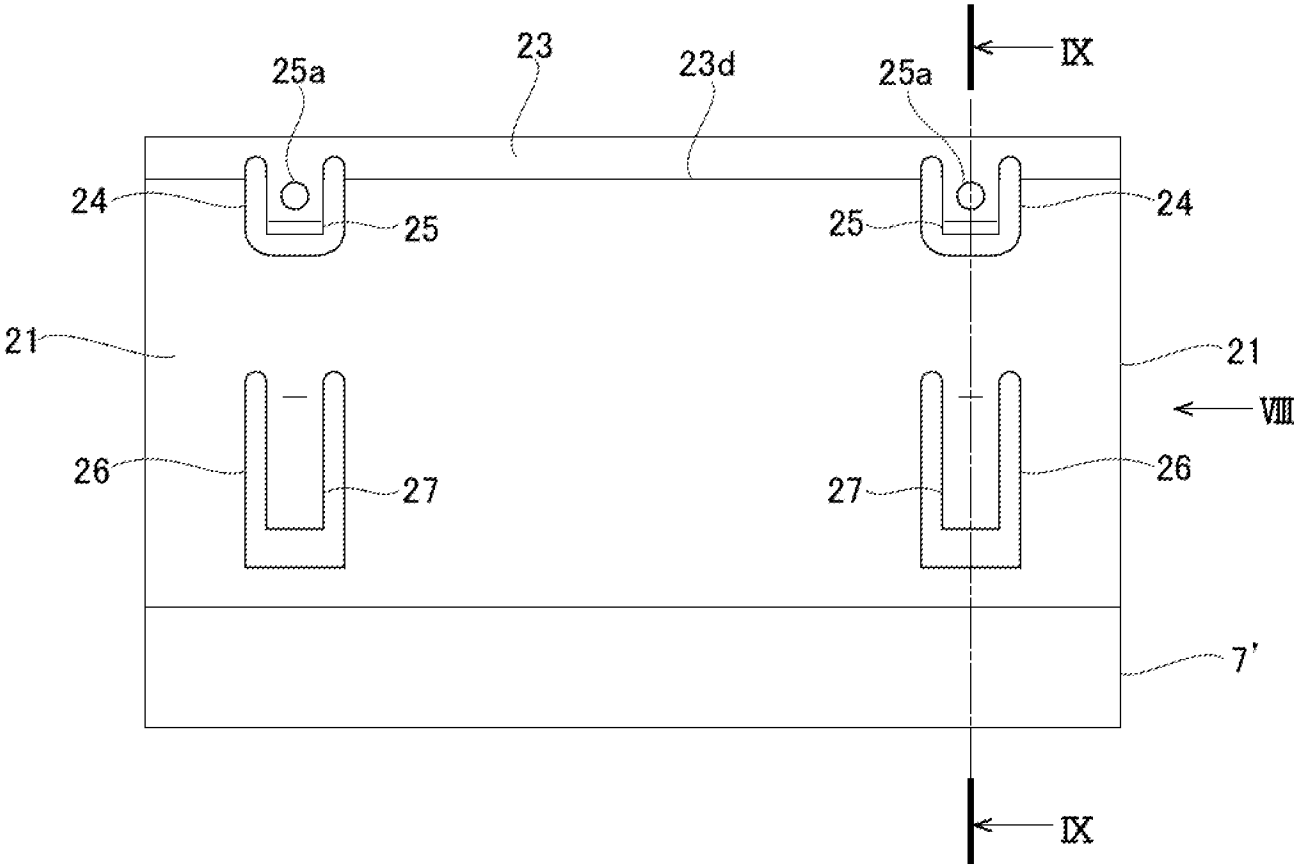
FIG. 6 is a side surface view of a perpendicular type substrate antenna and a flat shaped antenna.
Figure 7:
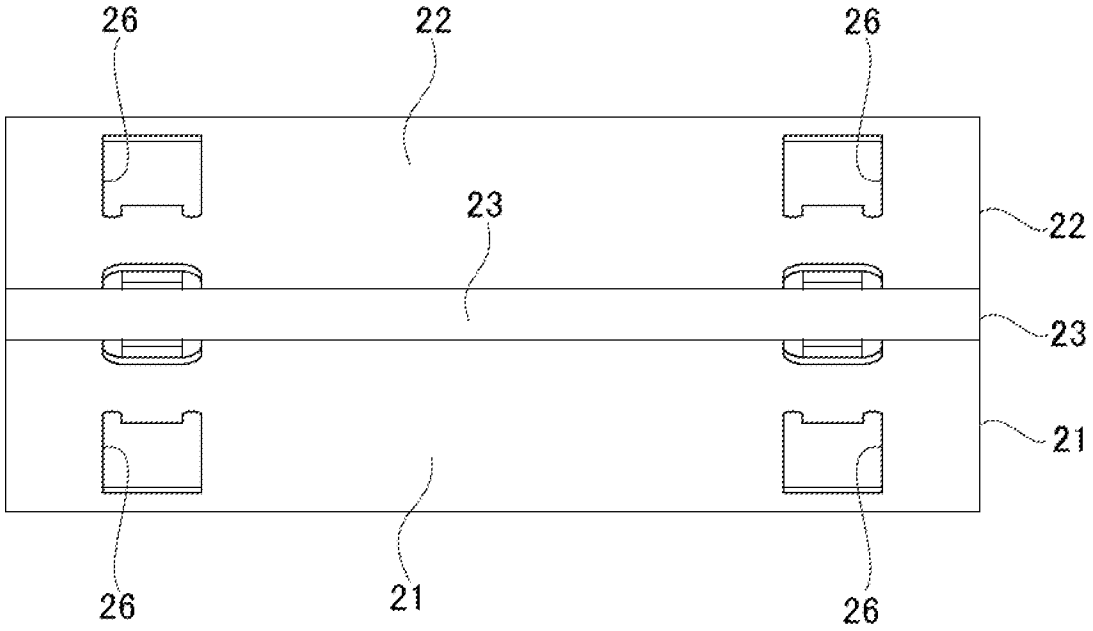
FIG. 7 is planar view of a perpendicular type substrate antenna and a flat shaped antenna.

Furthermore, first U shaped slits 24, 24 seen from the side direction shown in FIG. 6 are formed to pass through in the vicinity of both front and rear ends of the flat parts 21, 22 across the curved parts 23*d*, 23*e*. Because the curved parts 23*d*, 23*e* are not formed on ligulas 25, 25 which remain on the interior side of the first slits 24, 24, the ligulas 25, 25 more strongly press on both the front and rear surfaces of the perpendicular substrate antenna 7' as a part of the clip par 23. Furthermore, because circular holes 25*a*, 25*a* are formed passing through the center of the ligulas 25, 25, it is possible to solder each ligula 25, 25 on the front and rear surface of the perpendicular substrate antenna 7 through the holes 25*a*, 25*a*. In addition, the ends of each ligula 25, 25 curve back to the exterior as shown in FIG. 8 and FIG. 9. This is to allow the ligulas 25, 25 to be pushed open to the exterior when the perpendicular substrate antenna 7 is pushed into the clip 23, and to prevent the surface of the perpendicular substrate antenna 7 from being damaged by the end edges of the ligulas 25, 25.

U shaped second slits 26, 26 having the same width as the first slits 24, 24 and longer in a vertical direction than the first slits 24, 24 are formed passing through the lower part of the first slits 24, 24 on each flat part 21, 22. As is shown in FIG. 8 and FIG. 9, the arms 27, 27 which are the ligulas which remain on the interior side of the second slits 26, 26 curve (plastic deformation) to the interior and the vicinity of end of a slit contacts with the front and rear surface of the perpendicular substrate antenna 7' and thereby a reduction in the distance up to the aperture angle β with respect to the perpendicular substrate antenna 7 of each flat part 21, 22 and a reduction in the distance up to the perpendicular substrate antenna 7' is regulated. Furthermore, as is shown in FIG. 8 and FIG. 9, the ends of each arm part 27, 27 curve back towards the exterior. This is also to allow each arm part 27, 27 to be pushed open to the exterior when the perpendicular substrate antenna 7' is pushed into the clip 23, and to prevent the surface of the perpendicular substrate antenna 7' from being damaged by the end edges of each arm part 27, 27. In addition, in order to securely obtain the effect of regulating a reduction in distance up to the aperture angle β and perpendicular substrate antenna 7' by the arms parts 27, 27 described above, a hole or slit may be formed to prevent misalignment by latching with the arms parts 27, 27 in a position at which each arm part 27, 27 contacts the front and rear surface of the perpendicular substrate antenna 7.

Furthermore, regulation of an increase in the distance up to the aperture angle β with respect to the perpendicular substrate antenna 7 and a reduction in the distance up to the perpendicular substrate antenna 7 of each flat part 21, 22 in the plate shaped antenna 20 according to the second embodiment of the present invention is performed by elasticity with respect to elastic deformation of the clip part 23 described above which operates to allow each pair of flat parts 21, 22 to approach each other.

As explained above, even when the plate shaped antenna 20 of the second embodiment is used, assembly by an assembly operator is easy and because special components are not required for fixing the plate shaped antenna 20 to the perpendicular substrate antenna 7', assembly costs and component costs can be reduced. Moreover, because the plate shaped antenna 20 is fixed rigidly to the perpendicular substrate antenna 7' producing no vibrations, long term reliability is excellent, it is possible to set the clearance with the interior surface of the cover 1 to a minimum and therefore the level of design freedom of the cover 1 and antenna is high.

Other effects of the second embodiment are the same as those described in the first embodiment and thus an explanation is omitted here.

Modified Example

Although each embodiment described a perpendicular substrate antenna 7, 7' which are circuit boards formed with an antenna pattern, it is possible to secure the area of a plate shaped antenna and if reception of multiple types of radio wave is not required then the perpendicular substrate antenna 7, 7' is not essential. In this case, a plate or frame shaped object comprised from an insulator may also be used as a support part instead of the perpendicular substrate antenna 7, 7'.

In addition, although each embodiment described above supposes a current to flow while the cover 1 is attached to the antenna unit, the cover 1 is not an essential requirement of the present invention. An inner cover which covers at least the perpendicular substrate antenna 7, 7' on the interior of the cover 1 attached by a finished vehicle maker may also be attached to the antenna unit. In this case, a support part may also be used as an inner cover. In this case, an arm of the plate shaped antenna 20 passes through a hole arranged on a side surface of the inner cover and is fixed and thereby it is possible to arrange the plate shaped antenna 20 so that it is covered by the inner cover.

What is claimed is:

1. An antenna unit mounted on a vehicle roof comprising:

a base plate comprised of a metal plate, the base plate is arranged to the roof of the vehicle;

a support part fixed in a perpendicular direction with respect to an upper surface of the base plate; and a main antenna part fixed to the support part, the main antenna part includes a plate shaped antenna, the plate shape antenna comprises a pair of flat parts and arm parts, each of the arm parts including a contact arm and a latching arm, wherein the pair of flat parts have a gable roof type shape, the pair of flat parts are arranged facing both side surfaces of the support part, and have at least one angular aperture with respect to the support part, the support part includes a plurality of slits, each of the arm parts is curved from a corresponding one of the pair of flat parts toward the support part in a direction towards a bottom edge of each of the flat parts, the contact arm of each of the flat parts contacts with a corresponding surface of the support part, the latching arm of each of the flat parts passes through a corresponding one of the plurality of slits of the support part, and a tip end of each of the latching arms latches with a corresponding surface on an opposite side of the support part, and a surface area of the arm part which faces the base plate is smaller than a surface area of the flat part which faces the base plate.

2. The antenna unit according to claim 1, wherein the main antenna part further comprises a clip part which clamps the upper edge vicinity of the support part.

3. The antenna unit according to claim 1, wherein the arm part is a conductive component and a tip end of the contact arm curved from each of the pair of flat parts is pushed against a surface of the support part.

4. The antenna unit according to claim 1, wherein the support part further comprises an antenna pattern electrically connected to the main antenna part.

5. The antenna unit according to claim 2, wherein the support part further comprises an antenna pattern electrically connected to the main antenna part.

6. The antenna unit according to claim 1, wherein the support part further comprises an antenna pattern electrically connected to the main antenna part.

7. The antenna unit according to claim 3, wherein the support part further comprises an antenna pattern electrically connected to the main antenna part.

* * * * *